US007775732B2

(12) United States Patent
Kim

(10) Patent No.: US 7,775,732 B2
(45) Date of Patent: Aug. 17, 2010

(54) MULTI-ROLL PAPER SUPPLY FOR PRINTER

(75) Inventor: Jay Hyuk Kim, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 876 days.

(21) Appl. No.: 11/565,226

(22) Filed: Nov. 30, 2006

(65) Prior Publication Data

US 2008/0131185 A1 Jun. 5, 2008

(51) Int. Cl.
*B41J 11/50* (2006.01)

(52) U.S. Cl. ..... 400/609; 400/607.1; 400/613

(58) Field of Classification Search ..... 400/605, 400/607, 607.1, 609, 613; 242/474.5, 474.8, 242/559, 559.1, 559.2, 559.3; 399/384
See application file for complete search history.

(56) References Cited

U.S. PATENT DOCUMENTS 4,173,420 A * 11/1979 Okabe ..... 400/618
4,229,113 A * 10/1980 Anderson et al. ..... 400/596
4,265,440 A 5/1981 Shibazaki et al.
4,763,889 A 8/1988 Dei et al.
4,826,336 A * 5/1989 Kamimura et al. ..... 400/607
5,028,041 A 7/1991 Kobayashi
5,029,833 A 7/1991 Tani et al.
5,061,958 A 10/1991 Bunker et al.
5,139,353 A * 8/1992 Ota ..... 400/584
5,149,217 A * 9/1992 Narita ..... 400/608.4
5,174,560 A * 12/1992 Fujii ..... 271/15
5,228,630 A * 7/1993 Nakai et al. ..... 242/474.5
6,125,242 A 9/2000 Yamada
6,285,843 B1 9/2001 Obata
6,361,163 B1 3/2002 Fowlkes
6,511,240 B2 1/2003 Yamada
6,579,021 B2 * 6/2003 Deshayes et al. ..... 400/584

(Continued)

FOREIGN PATENT DOCUMENTS

EP 0654932 A1 5/1995

(Continued)

*Primary Examiner*—Judy Nguyen
*Assistant Examiner*—David Banh
(74) *Attorney, Agent, or Firm*—Yee & Associates, P.C.; Jason O. Piche

(57) ABSTRACT

Apparatus supplies a printer used in a POS location or other printer station with paper from two different rolls. A detection device recognizes when the feeding roll is about to run out of paper, whereupon the paper feeding task is automatically switched to the other roll. An operator only needs to service a printer station before both rolls of paper run out in order to prevent a downtime. One embodiment is directed to apparatus for supplying paper to a printer disposed to receive paper from either a first or a second paper roll. The apparatus comprises first and second roller sets corresponding to first and second paper rolls, respectively, each roller set being operable when receiving power to supply paper from its corresponding paper roll to the printer. The apparatus further comprises a single power source, and a power delivery mechanism for adapting the first and second roller sets to receive power from the source during first and second operating modes, respectively, of the mechanism. A device is provided to monitor the amount of paper remaining on the roll feeding the printer, and to direct the mechanism to change modes before the remaining amount runs out.

20 Claims, 6 Drawing Sheets

U.S. PATENT DOCUMENTS

2001/0046405 A1 11/2001 Miyazaki
2004/0065992 A1* 4/2004 Youn ..... 271/121
2005/0116080 A1* 6/2005 Kaneko et al. ..... 242/530.1
2007/0101880 A1* 5/2007 Wiedemer et al. ..... 101/228

FOREIGN PATENT DOCUMENTS

WO WO 2004108420 A1 * 12/2004

* cited by examiner

MULTI-ROLL PAPER SUPPLY FOR PRINTER

BACKGROUND OF THE INVENTION

1. Field of the Invention

The invention disclosed and claimed herein generally pertains to an apparatus and method for enabling a printer to be supplied with paper from either of two or possibly more rolls. More particularly, the invention pertains to apparatus of the about type wherein paper being supplied to the printer is automatically transferred from one roll to the other. Even more particularly, the invention pertains to apparatus of the above type wherein transfer between rolls occurs upon sensing that the roll feeding the printer is about to run out of paper.

2. Description of the Related Art

In stores and other shopping areas, it has become common to have printers located at point-of-sale (POS) terminals or locations, such as in kiosks, at check out counters, and the like. Each time a clerk or store employee rings up a sale, a computer-operated printer rapidly prepares a customer receipt, from paper contained on a roll. Customers can thereby be provided with paper records for all transactions, in a manner that is efficient and inexpensive. As a further example, printers are commonly used with paper rolls in theaters or other sites requiring admission, to print and dispense tickets.

A drawback in using printers of the above type is that paper rolls must be periodically replaced, when the paper on respective rolls runs out. In a commercial environment, it can be very inconvenient to have a printer roll run out of paper at a time of great activity, such as when numerous customers are waiting for service. A need to change printer rolls at a kiosk in a shopping mall or the like may be particularly troublesome, when there is only a single sales clerk to respond to customers, watch over merchandise and otherwise take care of business.

At present, the above situation is commonly dealt with by requiring an operator in a business establishment to be on call, in order to refill respective printers when they run out of paper. Most printers currently have paper-low and paper-empty sensors. Some even have means to send a message via Ethernet, to notify the operator to come to the printer and refill it with a new paper roll. However, if the operator comes too early, before the paper supply completely runs out, the remaining roll will be thrown away with useable paper still on it, in order to insert a new roll. On the other hand, if the operator comes too late, the kiosk or other POS location would have experienced down time during which it was not able to service customers.

BRIEF SUMMARY OF THE INVENTION

Embodiments of the invention generally provide a printer used at a kiosk or other POS location with two or more rolls of paper. A detection device is positioned to recognize that a roll being used to feed the printer is about to run out of paper, whereupon the paper feeding task is automatically switched to another roll. Thus, instead of being on call or waiting for notification from respective kiosks, an operator can simply make routine maintenance visits to respective POS locations, to replace any empty rolls of paper. The operator would only have to service a printer station before both rolls of paper run out, in order to prevent a downtime. Using this solution will significantly relieve or eliminate problems of the type described above, and will cut down on the cost of maintenance by reducing the amount of work an operator has to do for each printer. This, in turn, will enable the operator to manage a larger region and more POS printer stations. One embodiment of the invention is directed to apparatus for supplying printing paper to a printer that is disposed to receive paper from either a first paper roll or a second paper roll. The apparatus comprises first and second roller sets corresponding to first and second paper rolls, respectively, each roller set being operable when receiving power to supply paper from its corresponding paper roll to the printer. The apparatus further comprises a single power source, and a power delivery mechanism for adapting the first and second roller sets to receive power from the source during first and second operating modes, respectively, of the mechanism. A device is provided to monitor the amount of paper remaining on the roll feeding the printer, and to direct the mechanism to change modes before the remaining amount runs out.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
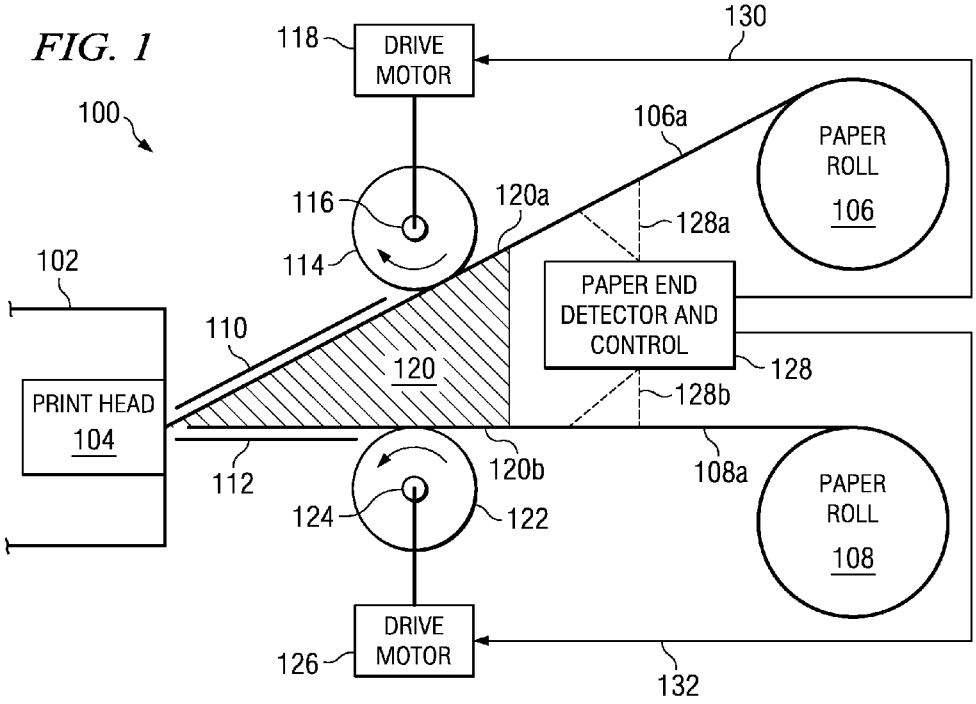
FIG. 1 is a schematic diagram showing an embodiment of the invention.

Referring to FIG. 1, there is shown a paper feeding apparatus 100 in accordance with an embodiment of the invention, for use in association with a printer 102 (shown only in part). Printer 102 has a print head 104, which is disposed to receive either paper 106*a* from a paper roll 106, or paper 108*a* from a paper roll 108. FIG. 1 shows paper guides 110 and 112 for routing paper to print head 104, from either roll 106 or 108, whenever printer 102 is operated to print out needed material. Printer 102, by way of example and not limitation, may be located at a POS terminal in a kiosk or other commercial place of business, may be in a theater ticket booth, or may be connected for operation by a computer or data processing system.

While not shown in detail, a "paper roll" as used herein refers to a continuous strip of paper wound or rolled upon a roll, roller or tube that is mounted for rotation. Thus, pulling on an end of the paper causes the paper to be progressively removed from the roll.

Referring further to FIG. 1, there is shown a driver roller 114 that is mounted for rotation on a shaft 116, and is linked to receive power from a drive motor 118. Activation of motor 118 rotatably drives roller 114 in a clockwise direction, as viewed in FIG. 1, causing driver roller 114 to feed paper 106*a* of roll 106 to print head 104. To further achieve this feeding action, a back plate 120 provides a paper guide surface 120*a* in closely spaced relationship with roller 114. Driver roller 114 bears against the surface 120*a* through paper 106*a*. Thus, driver roller 114 engages paper 106*a* with sufficient frictional force to move the paper into print head 104, when driver roller 114 is rotated by motor 118.

In similar fashion, a driver roller 122 is mounted for rotation on a shaft 124, rotatably driven by a drive motor 126, and bears against a paper guide surface 120*b* of back plate 120 through paper 108*a*. Activation of motor 126 rotates driver roller 122 in a counterclockwise direction, as viewed in FIG. 1, to feed paper 108*a* into print head 104.

FIG. 1 further shows paper feeding apparatus 100 provided with a paper end detector and control device 128. Device 128 is configured to control the operation of driver rollers 114 and 122, by selectively activating motor 118 to drive roller 114, or activating motor 126 to drive roller 122. Thus, device 128 determines whether paper at any given time is being fed to printer 102 from paper roll 106 or 108. Device 128 can also switch between the two rolls in supplying paper.

Device 128 is further configured to use any available technique, as will occur to those of skill in the art, to detect that the paper on either roll 106 or 108 is almost at its end. For example, device 128 could project scanned beams 128*a* and 128*b*, in order to detect the occurrence of special bar codes on paper 106*a* and 108*a*, respectively. The special bar code would be placed toward the end of paper loaded onto each roll, to indicate that the paper on the roll is nearly used up. Thus, when device 128 is operating a particular roller driver to feed paper from its corresponding paper roll to the printer, detection of the special code would notify the device 128 that the paper on the roll was almost exhausted. Device 128 would then halt operation of the feeding driver roller and activate the other driver roller, so that paper would continue to be supplied to printer 102. Control signals are usefully coupled from device 128 to operate motors 118 and 126 through signal transmission paths 130 and 132, respectively. Device 128 could include a processor, and could be constructed using one of a number of approaches well known to those of skill in the art.

Figure 2:
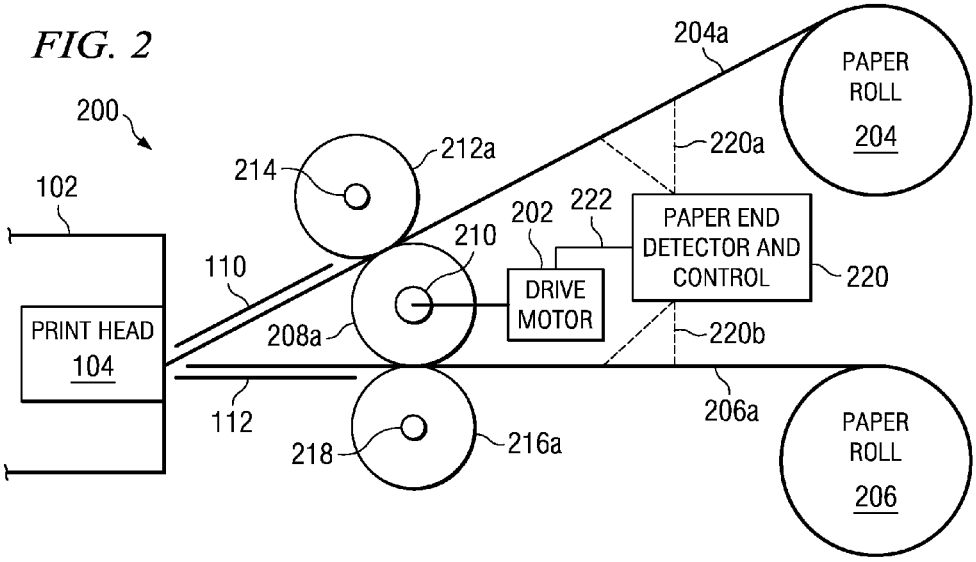
FIG. 2 is a schematic diagram showing a further embodiment of the invention.

Referring to FIG. 2, there is shown an embodiment comprising a paper feeding apparatus 200 for supplying paper to print head 104 of printer 102. Apparatus 200 uses a single power source such as a drive motor 202, rather than the two motors of apparatus 100, in order to selectively feed paper to printer 102 from either paper roll 204 or 206. In apparatus 200 of FIG. 2, a number of driver rollers such as roller 208*a* are carried upon a power shaft 210, which is linked to motor 202 and rotatably driven thereby. When power shaft 210 is rotated in a counterclockwise direction as viewed in FIG. 2, one or more driver rollers on the power shaft, together with complementary passive rollers such as roller 212*a* on a shaft 214, act in cooperation to feed paper 204*a* of paper roll 204 to the printer 102. Similarly, when power shaft 210 is rotated in a clockwise direction as viewed in FIG. 2, one or more driver rollers on the power shaft, together with complementary passive rollers such as 216*a* on a shaft 218, act in cooperation to feed paper 206*a* of paper roll 206 to the printer 102. Driver rollers such as 208*a*, passive rollers such as 212*a* and 216*a* and shafts 210, 214 and 218, as well as their respective interactions, are further described hereinafter in connection with FIGS. 3 and 4.

FIG. 2 further shows paper feeding apparatus 200 provided with a paper end detector and control device 220, similar or identical to device 128 shown in FIG. 1. Thus, device 220 projects scanned beams 220*a* and 220*b*, in order to detect the occurrence of special bar codes at the ends of paper 204*a* and 206*a*, respectively. When motor 202 is rotating shaft 210 in one direction, to feed paper from the corresponding paper roll, detection of the special code would notify device 220 that the paper on the roll was almost exhausted. Device 220 would then operate motor 202 to rotate shaft 210 in the opposite direction, so that paper would be supplied to the printer from the other roll. Control signals are usefully coupled to motor 202 from device 220 through a signal transmission path 222.

Figure 3:
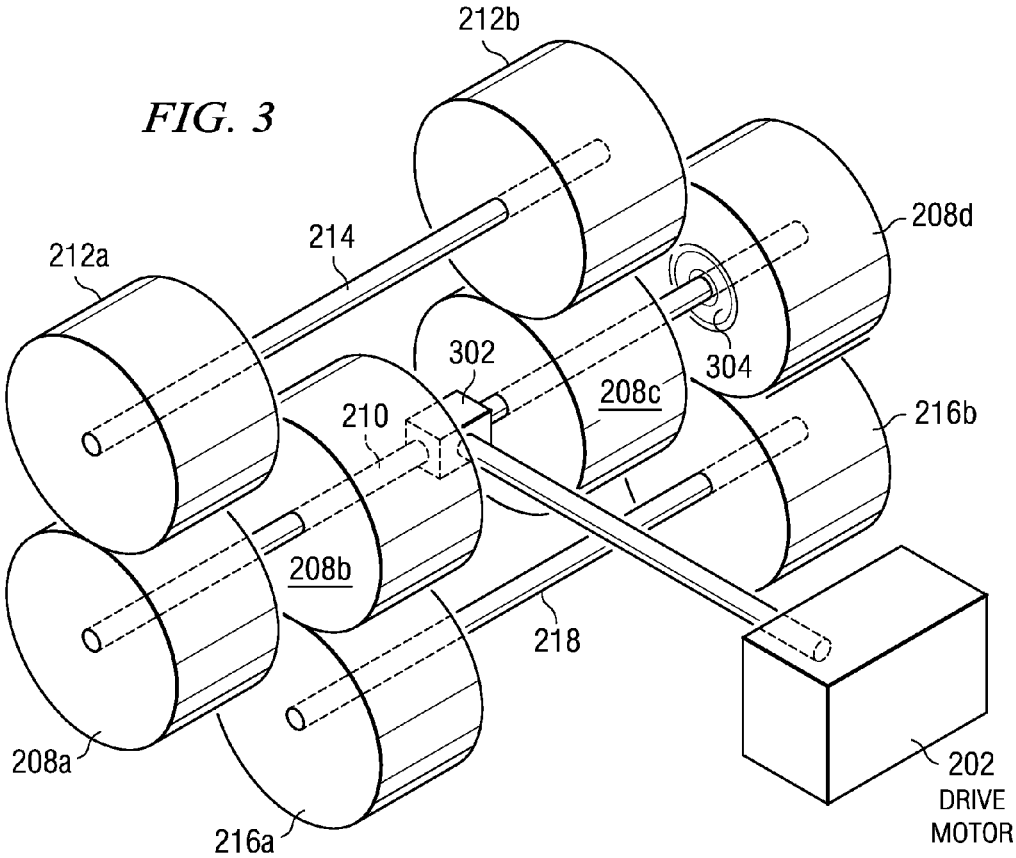
FIG. 3 is a schematic diagram showing a configuration of rollers for feeding paper in the embodiment of FIG. 2.

Referring to FIG. 3, there is shown power shaft 210 and shafts 214 and 218 in spaced apart parallel relationship with one another, and each supported for rotation (by means not shown). Shafts 214 and 218 are able to rotate freely. However, power shaft 210 receives rotary power through a coupling 302, from drive motor 202 as described above. Power shaft 210 is rotatably driven in either a counterclockwise or clockwise direction, as determined by motor 202.

Referring further to FIG. 3, there are shown driver rollers 208*a*-208*d* respectively carried upon power shaft 210, in spaced apart relationship with one another. Driver rollers 208*a* and 208*c* are in contacting engagement with passive rollers 212*a* and 212*b*, respectively, mounted for rotation on shaft 214. Thus, when power shaft 210 rotates driver rollers 208*a* and 208*c*, rollers 212*a* and 212*b* are rotatably driven thereby, respectively. Moreover, when power shaft 210 rotates in a counterclockwise direction, as viewed in FIG. 3, and driver rollers 208*a* and 208*c* are likewise driven to rotate counterclockwise, paper 204*a* of paper roll 204 will be fed to print head 104 of printer 102. This is achieved by the collective action of the roller set comprising driver rollers 208*a* and 208*c*, and passive rollers 212*a* and 212*b* respectively driven thereby. It will be readily apparent that a roller set could have a different number of driver rollers and corresponding passive rollers than two, for engaging and feeding paper 204*a*.

Similarly, when power shaft 210 rotates driver rollers 208*b* and 208*d*, passive rollers 216*a* and 216*b* are respectively rotated thereby. Moreover, when power shaft 210 rotates in a clockwise direction as viewed in FIG. 3, driver rollers 208*b* and 208*d* are likewise driven to rotate clockwise. Accordingly, paper 206*a* of paper roll 206 will be fed to print head 104 by the collective action of the roller set comprising driver rollers 208*b* and 208*d* and passive rollers 216*a* and 216*b*, respectively.

In apparatus 200, each driver roller 208*a*-*d* is journaled on power shaft 210 by means of a rotary bearing, such as bearing 304 shown to support driver roller 208*d*. Thus, each roller driver is able to turn freely with respect to power shaft 210, and need not rotate therewith. In order to feed paper 204*a* for paper roll 204 to the printer, a locking device is provided as described hereinafter in further detail, in connection with FIG. 4. The locking device locks driver rollers 208*a* and 208*c* to rotate with power shaft 210. However, driver rollers 208*b* and 208*d* are not locked to the power shaft. Motor 202 is then operated to rotate power shaft 210 in a counter clockwise direction, as viewed in FIG. 2. Driver rollers 208*a* and 208*c*, and their respective corresponding passive rollers 212*a* and 212*c*, are thus driven to feed paper of roll 204 to the printer. Driver rollers 208*b* and 208*d*, on the other hand, are not constrained to rotate with power shaft 210, and no rotary force is supplied thereto by the power shaft.

In order to feed paper 206*a* from paper roll 206, driver rollers 208*a* and 208*c* are released by the locking mechanism, and driver rollers 208*b* and 208*d* are locked to power shaft 210 for rotation therewith. Motor 202 is operated to rotate power shaft 210 in a clockwise direction, as viewed in FIG. 2. Accordingly, driver rollers 208*b* and 208*d* and their respective corresponding rollers 216*a* and 216*b* are driven to feed paper of roll 206 to the printer.

Figure 4:
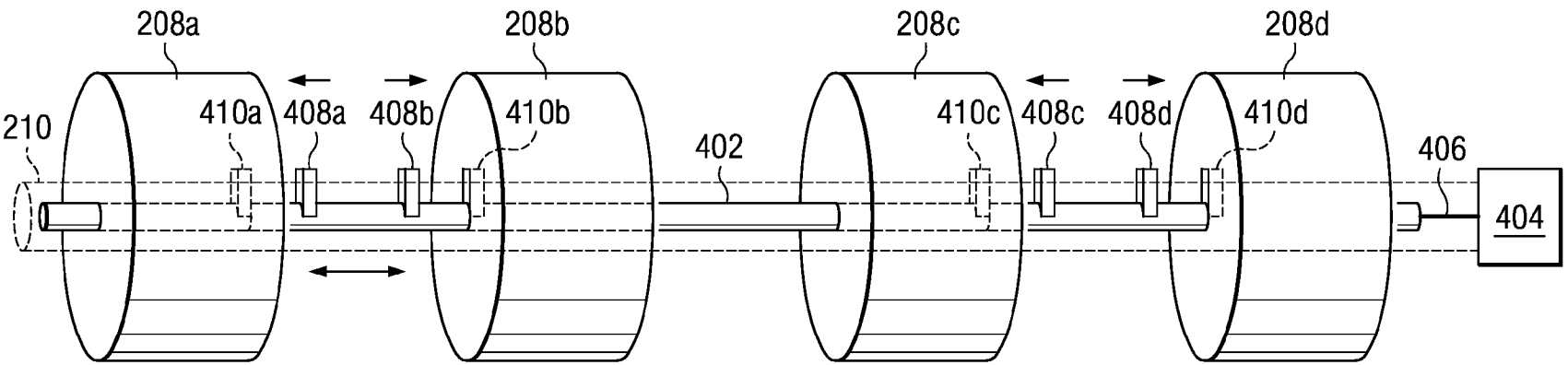
FIG. 4 is a schematic diagram showing a locking mechanism for the embodiment of FIG. 2.

Referring to FIG. 4, there is shown power shaft 210 comprising a hollow shaft containing a rod 402. Rod 402 is supported for limited reciprocal displacements within shaft 210, that is, movement to right and left as viewed in FIG. 4, over a specified range. Rod 402 is controllably reciprocated by a conventional actuation motor 404 that is attached to an end of shaft 210, and is coupled to drive rod 402 by means of a link 406. The operation of motor 404 is controlled by control 220 shown in FIG. 2.

Referring further to FIG. 4, there are shown keys 408*a*-408*d* respectively mounted on rod 402 for movement therewith, wherein keys 408*a*-408*d* correspond to driver rollers 208*a*-208*d*, respectively. Moreover, key ways or slots 410*a*-410*d* are formed in driver rollers 208*a*-208*d*, respectively, wherein each key way is sized to receive the key corresponding to its roller driver. A locking relationship may thereby be established between the driver roller and the shaft 210, through rod 402.

By providing the configuration of FIG. 4, driver rollers 208*a* and 208*c* can be locked to shaft 210 by operating motor 404 to move rod 402 leftward, as viewed in FIG. 4. Keys 408*a* and 408*c* are thereby inserted into key ways 410*a* and 410*c*, respectively. Shaft 210 can then be driven in a counterclockwise direction to feed printer 102 with paper from roll 204, as described above. In like manner, rod 402 is moved rightward, to insert keys 408*b* and 408*d* into key ways 410*b* and 410*d*, respectively. Driver rollers 208*b* and 208*d* are thereby locked to shaft 210, for rotation therewith. At the same time, keys 408*a* and 408*c* are withdrawn from key ways 410*a* and 410*c*, so that driver rollers 208*a* and 208*c* are released from shaft 210. Power shaft 210 may then be rotated in a clockwise direction, to feed printer 102 with paper from roll 206, as likewise described above. While not shown, various means well known to those of skill in the art may be used to align respective keys with their corresponding key ways, to facilitate insertion.

It is to be understood that numerous other arrangements for selectively locking and unlocking driver rollers with respect to shaft 210 will occur to those of skill in the art. All such arrangements are considered to be within the scope of the invention, and may include but are by no means limited to braking mechanisms and gear and sprocket arrangements.

Figure 5A:
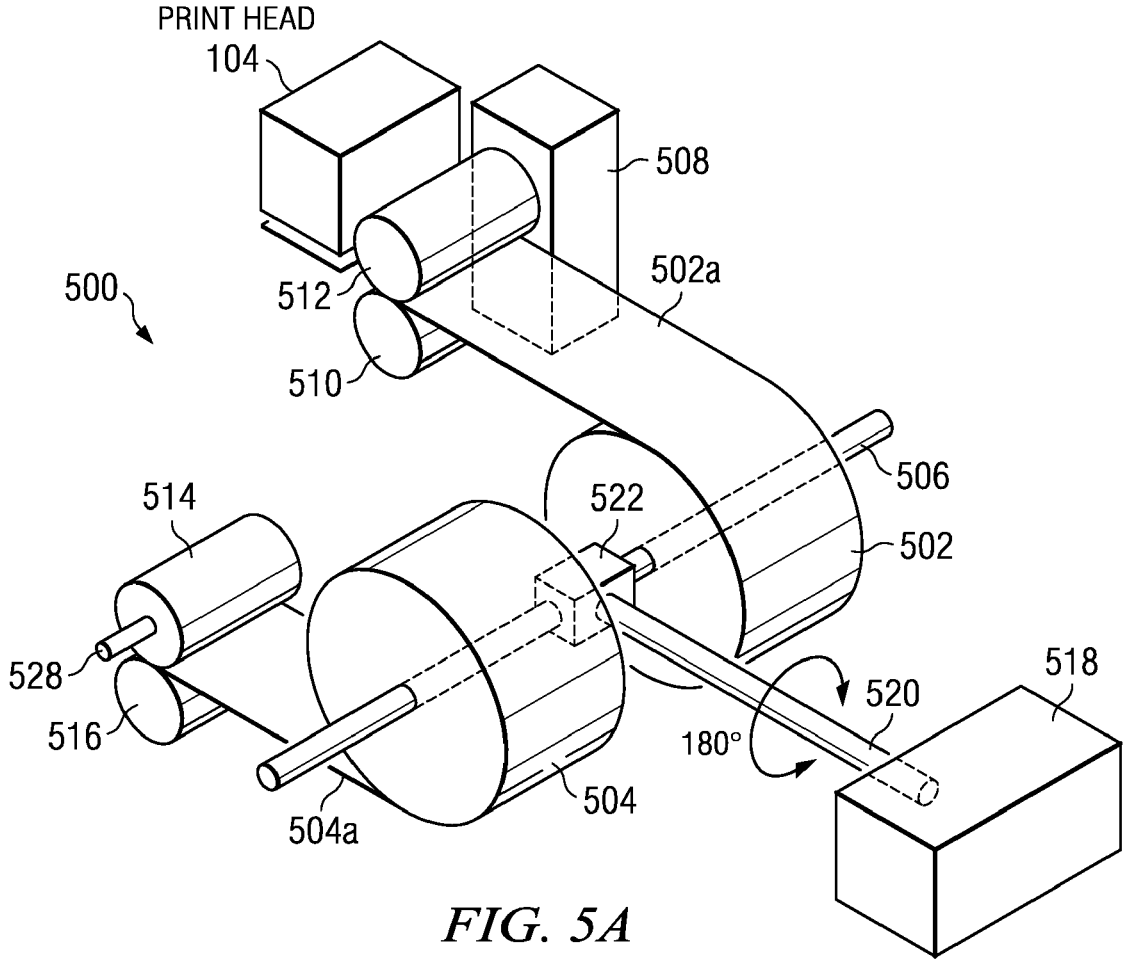
FIGS. 5A-5C are schematic diagrams showing respective modes of yet another embodiment of the invention.

Referring to FIG. 5A, there is shown an apparatus 500 for supplying paper to a print head 104 of a printer from either a paper roll 502 or 504. Paper rolls 502 and 504 are both mounted on a common shaft 506, in coaxial relationship therewith and with one another. The apparatus 500 shown in FIGS. 5A-5C reduces the amount of space that is needed to accommodate the paper rolls, and at the same time requires only a single motor to feed paper to the print head from either paper roll 502 or 504. Apparatus 500 is provided with two roller sets, one set comprising a driver roller 510 and a passive roller 512 in engaged or closely spaced relationship, in order to feed paper 502*a* of paper roll 502 to the printer. The other roller set comprises a driver roller 514 and a passive roller 516, likewise engaged to feed paper 504*a* of paper roll 504 to the printer.

Referring further to FIG. 5A, there is shown a control and power source 518 provided to turn or rotate a power shaft 520 through an angle of 180°, around the axis of shaft 520. Shaft 506, carrying paper rolls 502 and 504, is fixably joined at its center to power shaft 520, by a hub 522 or the like. Thus, rotation of shaft 520 acts to rotate shaft 506 through an angle of 180° about the axis of shaft 520, which is orthogonal to shaft 506.

Figure 5B:
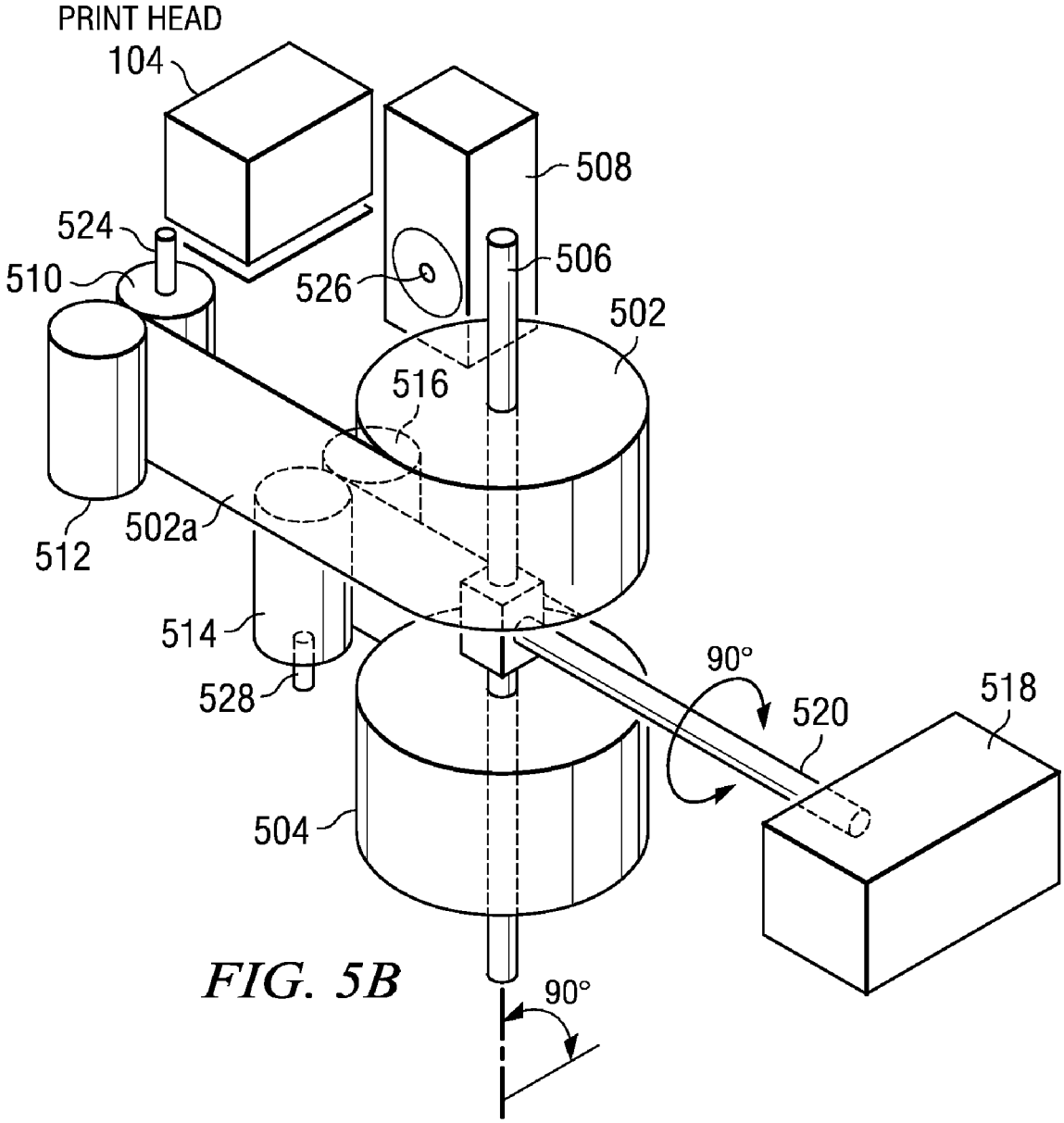
Figure 5C:
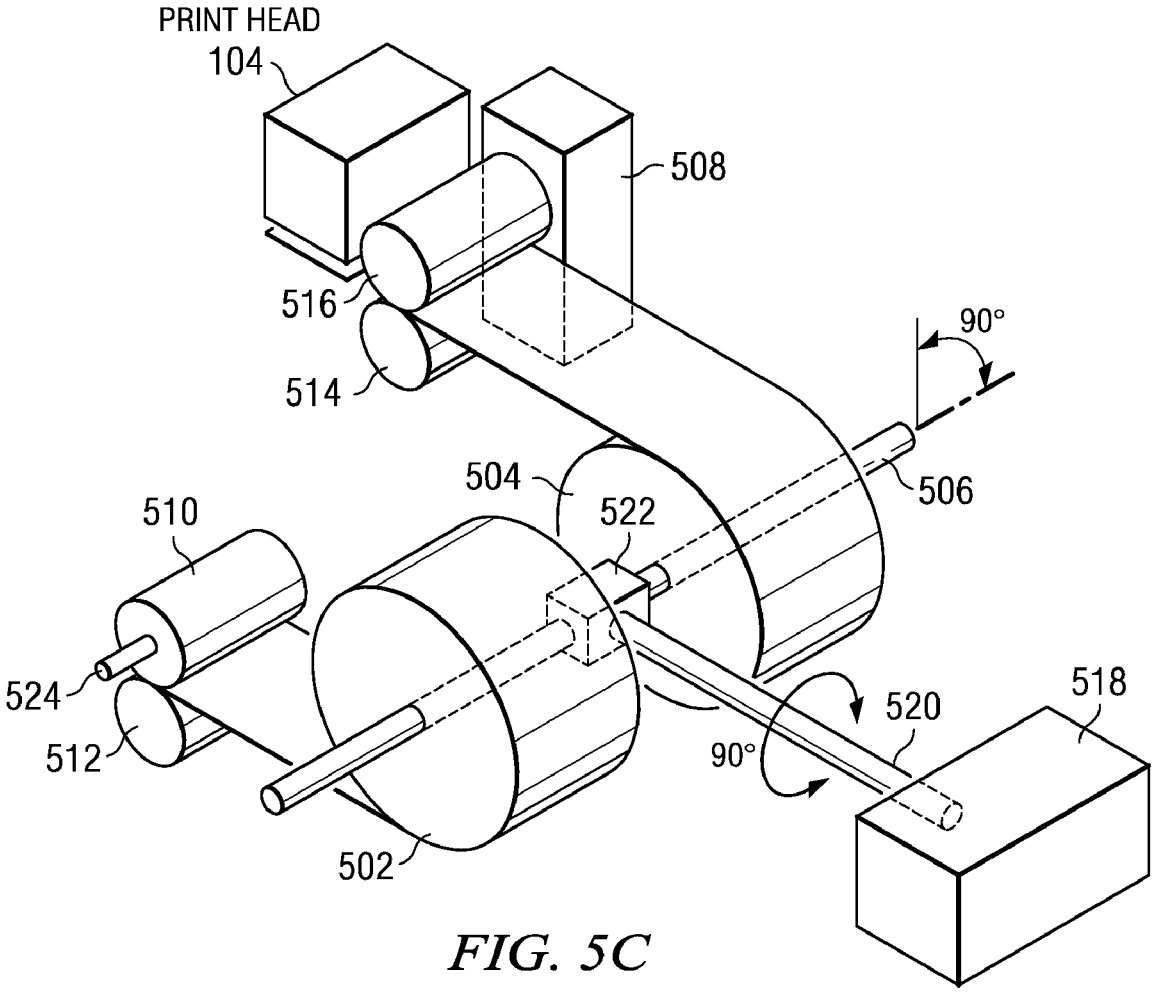

More particularly, shaft 506 can be rotated from the horizontal orientation shown in FIG. 5A, through the vertical orientation shown in FIG. 5B and to the horizontal orientation of FIG. 5C. The control and power source 518 can also rotate shaft 506 in the opposite direction. The paper rolls 502 and 504 mounted on shaft 506, as well as the roller sets comprising rollers 510 and 512 and rollers 514 and 516, respectively, are rotated with the shaft 506. Structure supporting shaft 506 for rotation, as well as structure joining the two roller sets for rotation with shaft 506, is not shown for simplicity of illustration but can readily be provided by those of skill in the art.

As shaft 506 is moved into the horizontal mode shown in FIG. 5A, driver roller 510 becomes mechanically linked to motor 508. In a useful embodiment, this is accomplished by attaching a driving element 524 to driver roller 510, as shown by FIG. 5B. When shaft 506 is rotated to the orientation shown in FIG. 5A, element 524 is inserted into a complementary receptacle 526 of motor 508. Thereupon, operation of motor 508 will drive rollers 510 and 512 to feed paper of roll 502 to the printer. Motor 508 is usefully operated by the control 518.

FIG. 5B shows that driving element 524 is withdrawn from receptacle 526 of motor 508, when shaft 506 is rotated from the horizontal mode of FIG. 5A. FIG. 5B further shows roller driver 514 of the other roller set provided with a driving element 528 similar to driving element 524.

When shaft 506 is oriented to the horizontal mode of FIG. 5C, driving element 528 of driver roller 514 is inserted into receptacle 526. Thus, operation of motor 508 will drive rollers 514 and 516 to feed paper of roll 504 to the printer.

It will be seen that power source and control 518, by selective rotation of shaft 506 and paper rolls 502 and 504, can readily transfer the task of supplying paper to the printer from one roll to the other. While not shown, a paper end detector such as detector 220, described above, can be positioned to sense that the paper on the supplying roll is almost gone. The detector would then notify control 518 to rotate shaft 506 and the paper rolls carried thereby, in order to switch the supply task to the other roll.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. In association with a data processing system, an apparatus comprising a plurality of paper rolls;

a single printer configured to selectively receive paper from each paper roll of said plurality of paper rolls, and configured further to receive paper from only one of said paper rolls at a given time;

a single power source;

a plurality of roller sets, one roller set corresponding to one paper roll of said plurality of paper rolls, wherein each roller set is configured to supply paper from its corresponding paper roll to said single printer in response to receiving power from said single power source;

a power delivery mechanism having a plurality of operating modes, wherein each operating mode corresponds to a different one of said roller sets, said power delivery mechanism being operable to adapt each roller set to receive power during its corresponding operating mode from said power source; said power delivery mechanism being further operable to prevent each roller set from receiving power from said power source during an operating mode that corresponds to a different roller set; and a device for monitoring the amount of paper remaining on the paper roller of a particular roller set that is supplying paper to the printer at said given time, wherein said device is operable to direct said power delivery mechanism to change the roller set supplying paper to the printer from said particular roller set to a different roller set, by selectively changing the operating modes of said power delivery mechanism before said remaining amount of paper is used up.

2. The apparatus of claim 1, wherein said device for monitoring the amount of paper remaining comprises a paper end detector.

3. The apparatus of claim 1, wherein the single printer is used at a specified point-of-sale terminal or in a specified data processing system, selectively.

4. In association with a data processing system, apparatus comprising:

first and second paper rolls;

a single printer configured to selectively receive paper from both first and second paper rolls, and configured to further receive paper from only one of said paper rolls at a given time;

a single power source;

a first roller set corresponding to said first paper roll, and a second roller set corresponding to said second paper roll, wherein each roller set is configured to supply paper from its corresponding paper roll to said single printer in response to receiving power from said single power source;

a power delivery mechanism having a first operating mode corresponding to said first roller set and a second operating mode corresponding to said second roller set, said power delivery mechanism being operable to adapt said first and second roller sets to receive power from said source during said first and second operating modes, respectively, and said power delivery mechanism being further operable to prevent each roller set from receiving power from said power source during the operating mode that corresponds to the other roller set; and a device for monitoring the amount of paper remaining on the paper roll of the particular roller set that is supplying paper to the printer at a given time, wherein said device is operable to direct said mechanism to change the roller set supplying paper to the printer from said particular roller set to the other roller set, by selectively changing the operating mode of said power delivery mechanism before said remaining amount is used up.

5. The apparatus of claim 4, wherein said first roller set comprises a first driver roller;

said second roller set comprises a second driver roller; and said power delivery mechanism further comprises a power shaft carrying said first and second driver rollers belonging to said first and second roller sets;

a first shaft parallel to said power shaft carrying a first passive roller that is in engagement with said first driver roller carried by said power shaft;

a second shaft parallel to said power shaft carrying a second passive roller that is in engagement with said second driver roller carried by said power shaft; and a linkage for transferring power from said single power source, to rotate said power shaft in a clockwise direction during said first operating mode and to rotate said power shaft in a counterclockwise direction during said second operating mode.

6. The apparatus of claim 5, wherein:

said power delivery mechanism further comprises a device for locking said first driver roller for rotation with said power shaft during said first operating mode, and for locking said second driver roller for rotation with said power shaft during said second operating mode.

7. The apparatus of claim 6, wherein:

said locking device includes a complementary key and key way components for each of said first and second driver rollers carried on said power shaft, to selectively lock respective driver rollers for rotation with said power shaft.

8. The apparatus of claim 7, wherein:

said first and second driver rollers carried on said power shaft is mounted to rotated freely with respect to said power shaft, when not locked for rotation with said power shaft.

9. The apparatus of claim 5, wherein:

said power shaft carries a plurality of driver rollers for both first and second roller sets.

10. The apparatus of claim 4, wherein said power delivery mechanism comprises:

a first shaft supported for rotation carrying both first and second paper rolls;

a second shaft fixably joined to said first shaft in orthogonal relationship therewith, said second shaft having an axis; and a power mechanism for selectively rotating said first shaft about the axis of said orthogonal second shaft between first mode and second mode orientations, in order to position said first and second paper rolls, respectively, to supply paper to said printer.

11. The apparatus of claim 10, wherein:

said first and second roller sets are mounted for rotation with said shaft and with said paper rolls.

12. The apparatus of claim 11, wherein:

at least one driver roller of said first roller set is coupled to receive rotary power from said single power source, when said first shaft is rotated to said first mode orientation, and at least one driver roller of said second set is coupled to receive rotary power from said single power source, when said first shaft is rotated to said second mode orientation.

13. The apparatus of claim 10, wherein:

said first shaft rotates through substantially 180° when rotating between said first and second mode orientations.

14. The apparatus of claim 4, wherein:

said printer is used at a specified point-of-sale terminal.

15. The apparatus of claim 4, wherein:

said printer is used in said specified data processing system.

16. A method in a data processing system for supplying paper to said printer comprising the steps of:

providing a first and second of paper rolls;

providing first and second roller sets, adapting said first and second roller sets to supply paper to said printer from said first and second paper rolls, respectively, when said first and second roller sets receive power;

providing a single power source;

providing a power delivery mechanism for adapting said first roller set to receive power from said single power source during a first operating mode and adapting said second roller set to receive power from said single source during a second operating mode, said power delivery mechanism preventing said first roller set from receiving power from said single power source during said second operating mode and preventing said second roller set from receiving power from said single power source during said first operating mode;

monitoring the amount of paper remaining on a particular paper roll supplying the printer at a given time; and changing from the operating mode at the given time to the other operating mode before said remaining amount is used up.

17. The method of claim 16, further comprising the steps of:

providing a power shaft carrying first and second driver rollers belonging to said first and second roller sets respectively; and rotating said power shaft in a clockwise direction during said first operating mode, and;

rotating said power shaft in a counterclockwise direction during said second operating mode.

18. The method of claim 17, wherein:

said first driver roller is locked for rotation with said power shaft during said first operating mode, and said second driver roller is locked for rotation with said power shaft during said second operating mode.

19. The method of claim 16, further comprising the steps of:

providing a shaft carrying both said first and second paper rolls thereon for rotation; rotating said shaft between first mode and second mode orientations, in order to position said first and second paper rolls, respectively, to supply paper to said single printer.

20. The method of claim 19, wherein:

said first roller set comprises at least one driver roller coupled to receive rotary power from said single power source, when said shaft is rotated to said first mode orientation, and said second roller set comprises at least one driver roller coupled to receive rotary power from said single power source, when said shaft is rotated to said second mode orientation.

* * * * *